US009161584B1

(12) United States Patent
Garrett, Jr.

(10) Patent No.: US 9,161,584 B1
(45) Date of Patent: Oct. 20, 2015

(54) ILLUMINATED HEAD-GEAR ASSEMBLY

(71) Applicant: William E. Garrett, Jr., Inkster, MI (US)

(72) Inventor: William E. Garrett, Jr., Inkster, MI (US)

( * ) Notice: Subject to any disclaimer, the term of this patent is extended or adjusted under 35 U.S.C. 154(b) by 333 days.

(21) Appl. No.: 13/759,205

(22) Filed: Feb. 5, 2013

(51) Int. Cl.

| | |
|---|---|
| ***A42B 1/22*** | (2006.01) |
| ***A42B 1/00*** | (2006.01) |
| ***A42B 1/24*** | (2006.01) |
| *A42B 1/20* | (2006.01) |

(52) U.S. Cl.
CPC ..... *A42B 1/004* (2013.01); *A42B 1/242* (2013.01); *A42B 1/244* (2013.01); *A42B 1/205* (2013.01)

(58) Field of Classification Search
CPC ..... A42B 1/004; A42B 1/006; A42B 1/20; A42B 1/205; A42B 1/206; A42B 1/242; A42B 1/244; A42B 1/064; A42B 1/22; A42B 1/24; A42B 1/245; A42B 3/0433; A42B 1/044; F21L 15/14
USPC ..... 2/181, 209.12, 209.13, 175.1, 175.5, 2/195.1–195.4, 10, 12, 15; 362/106
See application file for complete search history.

(56) References Cited

U.S. PATENT DOCUMENTS

| | | | | |
|---|---|---|---|---|
| 4,873,726 | A | 10/1989 | Tapia | |
| 5,070,545 | A | 12/1991 | Tapia | |
| 5,359,734 | A | 11/1994 | Rathburn | |
| 5,477,629 | A | 12/1995 | Gleason, Jr. | |
| 5,485,358 | A * | 1/1996 | Chien | 362/106 |
| 5,613,246 | A * | 3/1997 | Alexander | 2/10 |
| 5,862,523 | A | 1/1999 | Proctor | |
| 6,070,270 | A | 6/2000 | De La Torre | |
| 6,094,749 | A * | 8/2000 | Proctor | 2/195.2 |
| 6,175,963 | B1 | 1/2001 | Loeffelholz | |
| 6,461,015 | B1 * | 10/2002 | Welch | 362/103 |
| 6,557,180 | B2 | 5/2003 | Hall McKenzie | |
| D488,293 | S | 4/2004 | Norway, Jr. | |
| D498,346 | S | 11/2004 | Kronenberger | |
| RE38,774 | E * | 8/2005 | Davis | 2/10 |
| 6,993,794 | B2 | 2/2006 | Hall et al. | |
| 2007/0283482 | A1 * | 12/2007 | Lawrence | 2/209.12 |
| 2009/0009990 | A1 * | 1/2009 | Tseng | 362/158 |
| 2009/0119819 | A1 * | 5/2009 | Thompson | 2/209.13 |
| 2011/0210685 | A1 * | 9/2011 | Liao | 315/313 |

* cited by examiner

*Primary Examiner* — Stephen F Husar
*Assistant Examiner* — Naomi M Wolford

(57) ABSTRACT

An illuminated head-gear assembly includes a cap that may be worn on a user's head. A retainer is removably coupled to the cap. A brim is removably coupled to the retainer. A strap is removably coupled to the cap to adjust a size of the cap. A first sleeve is positionable on the brim to alter an appearance of the brim. A front light emitter is coupled to the cap so the front light emitter emits light. A top light emitter is coupled to the cap so the top light emitter emits light. A motion sensor is coupled to the cap. The motion sensor is operationally coupled to the front and top light emitters so the motion sensor selectively actuates the front and top light emitters. An actuator is coupled to the cap. The actuator is operationally coupled to the motion sensor so the actuator actuates the motion sensor.

13 Claims, 6 Drawing Sheets

ILLUMINATED HEAD-GEAR ASSEMBLY

BACKGROUND OF THE DISCLOSURE

Field of the Disclosure

The disclosure relates to illuminated head-gear devices and more particularly pertains to a new illuminated head-gear device for attaching a plurality of accouterments.

SUMMARY OF THE DISCLOSURE

An embodiment of the disclosure meets the needs presented above by generally comprising a cap that may be worn on a user's head. A retainer is removably coupled to the cap. A brim is removably coupled to the retainer so the brim may shade the user's face. A strap is removably coupled to the cap so the strap adjusts a size of the cap. A first sleeve is positionable on the brim so the first sleeve alters a color of the brim. A front light emitter is coupled to the cap so the front light emitter emits light. A top light emitter is coupled to the cap so the top light emitter emits light. A motion sensor is coupled to the cap. The motion sensor is operationally coupled to the front and top light emitters so the motion sensor selectively actuates the front and top light emitters. An actuator is coupled to the cap. The actuator is operationally coupled to the motion sensor so the actuator actuates the motion sensor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
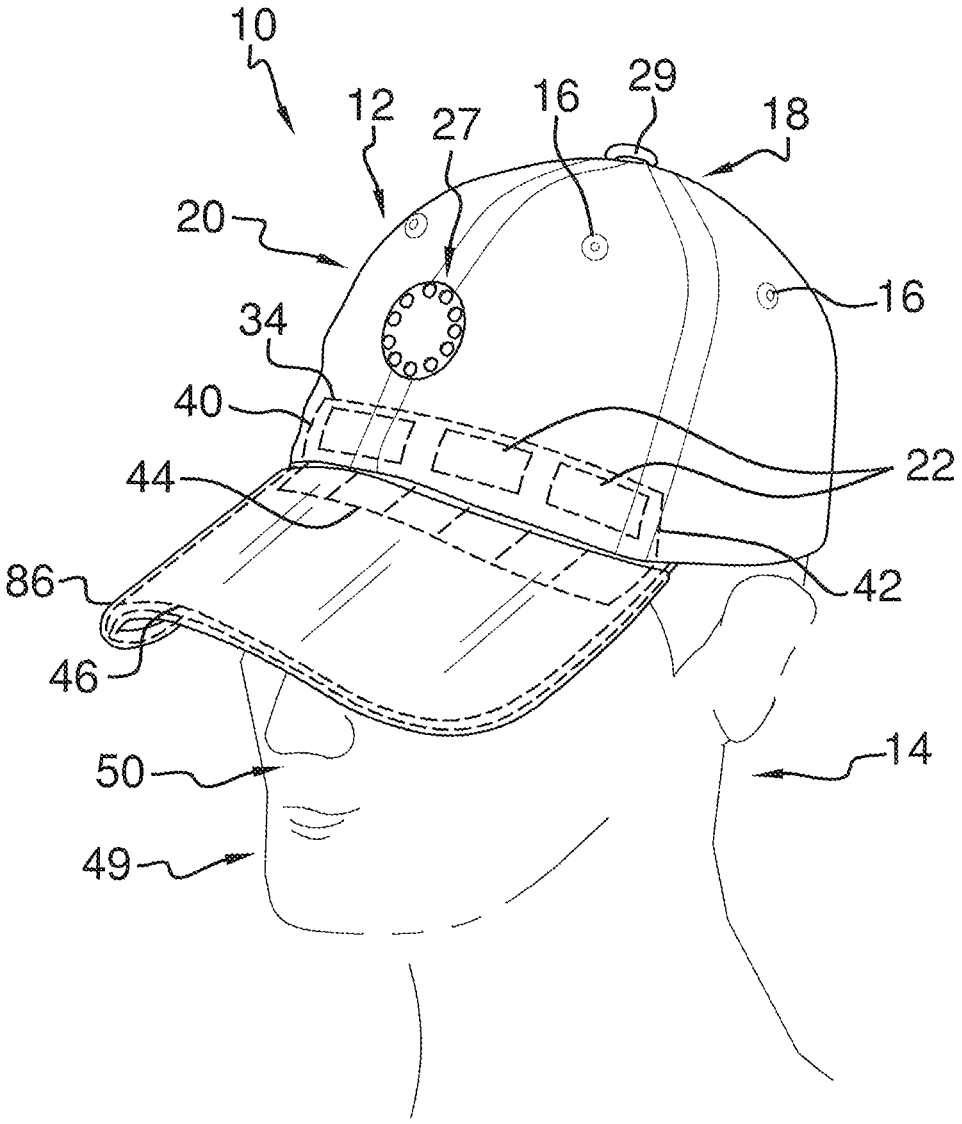
FIG. 1 is a perspective view of an illuminated head-gear assembly according to an embodiment of the disclosure.
Figure 2:
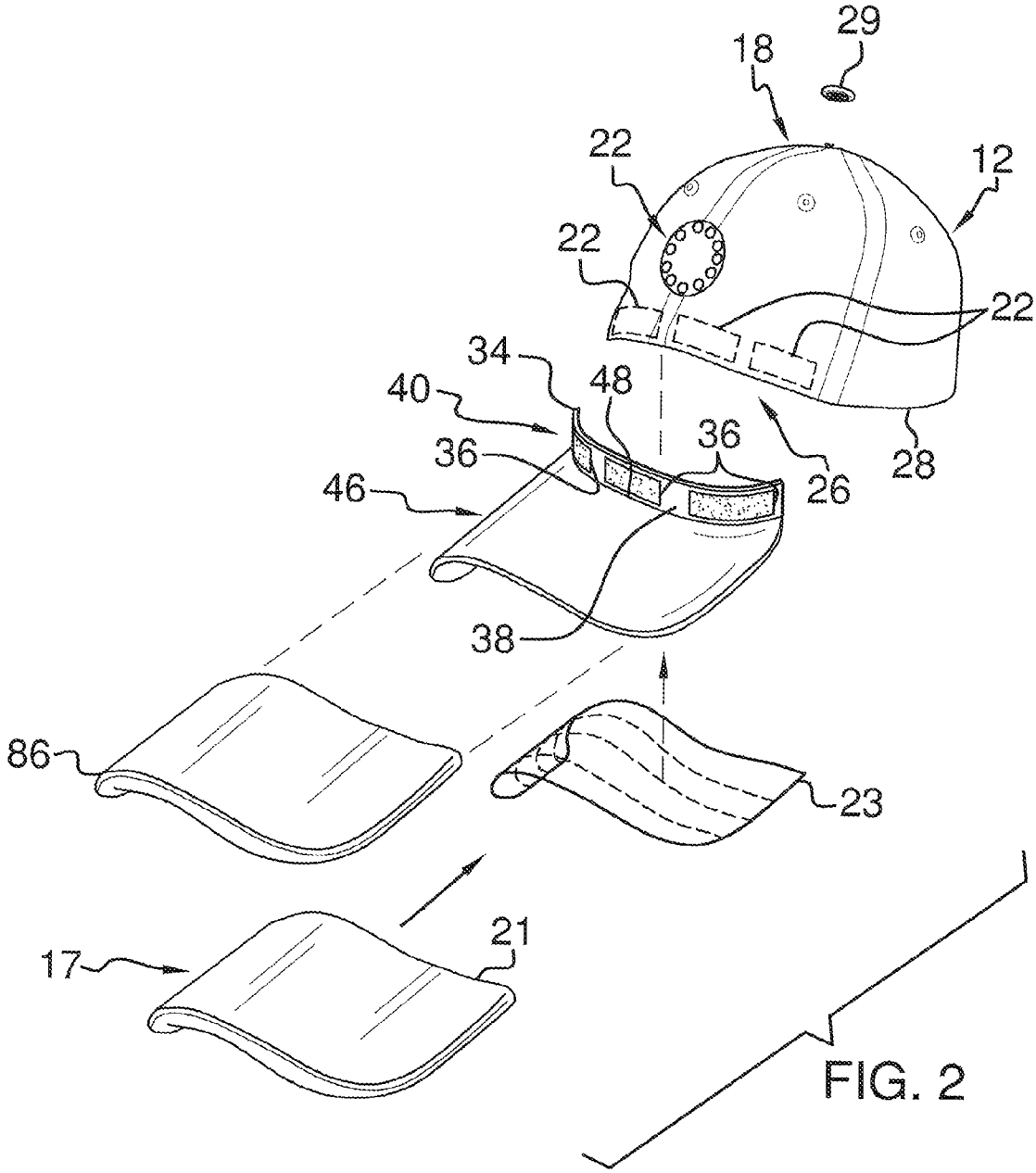
FIG. 2 is a front perspective view of an embodiment of the disclosure.
Figure 3:
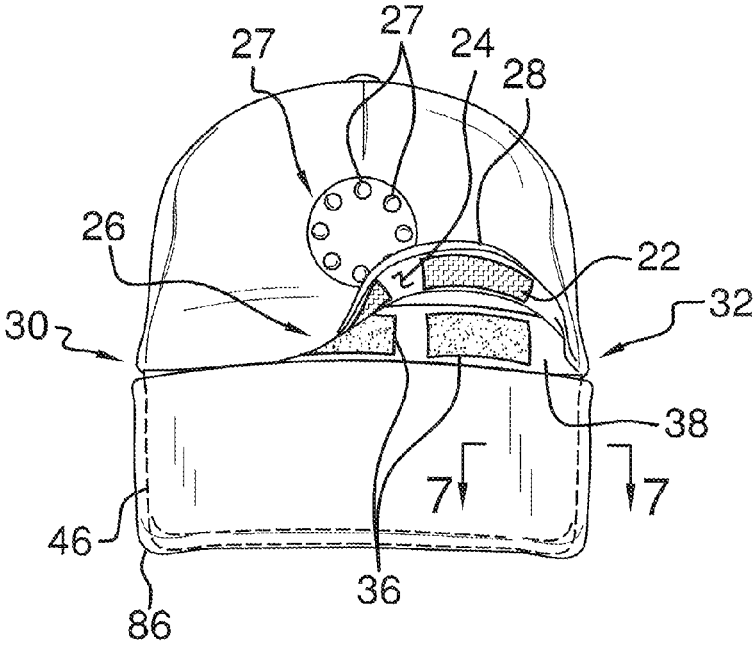
FIG. 3 is a front view of an embodiment of the disclosure.
Figure 4:
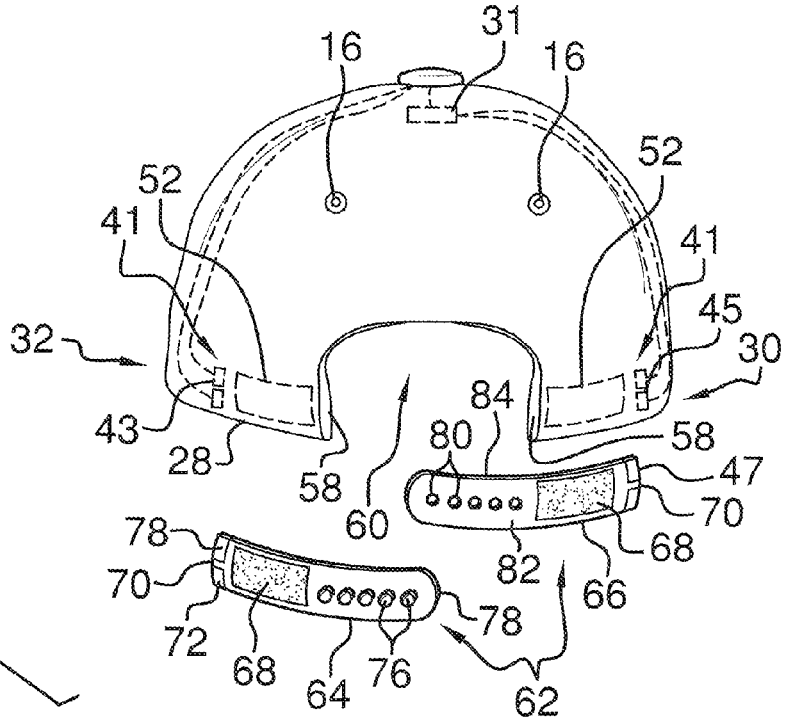
FIG. 4 is a back view of an embodiment of the disclosure.
Figure 5:
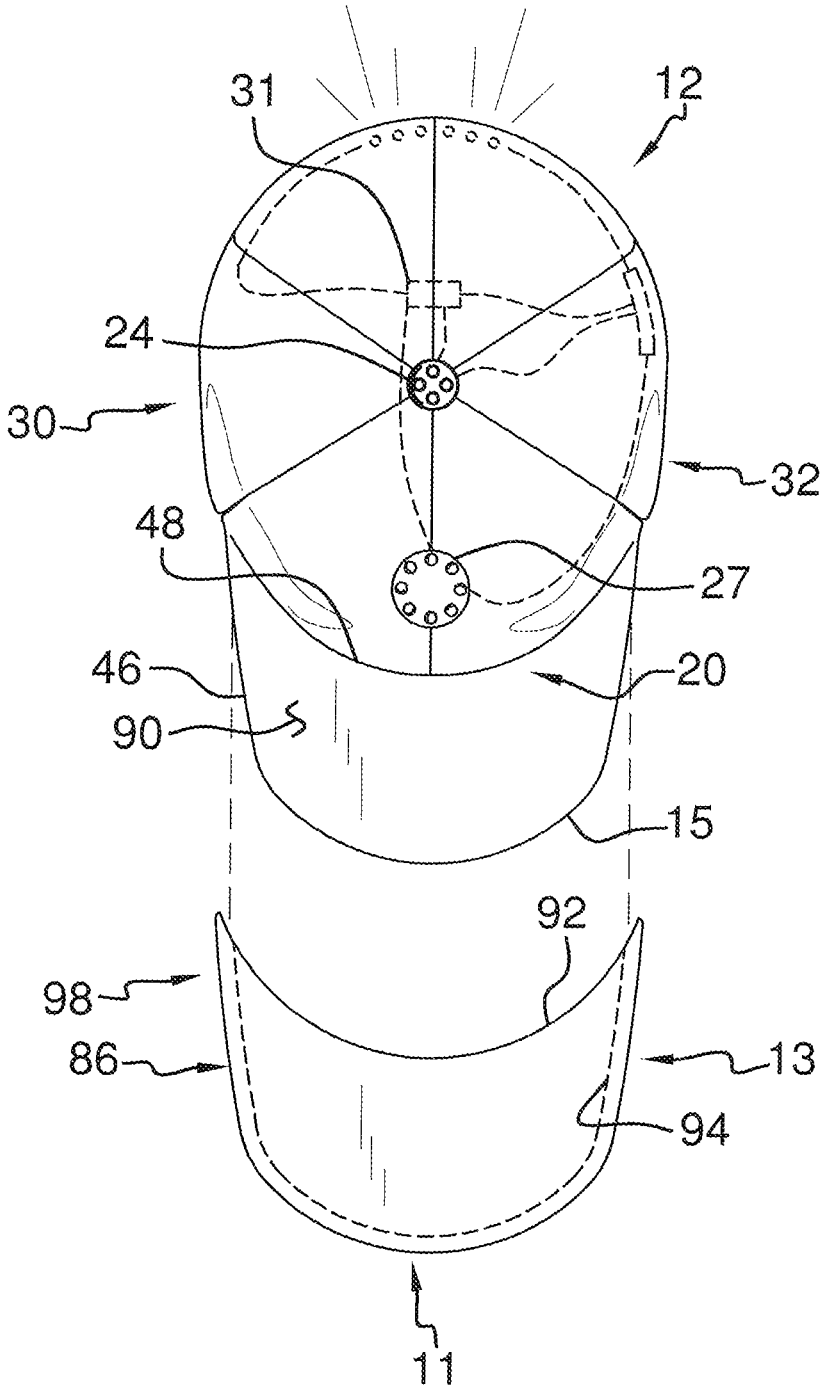
FIG. 5 is a top view of an embodiment of the disclosure.
Figure 6:
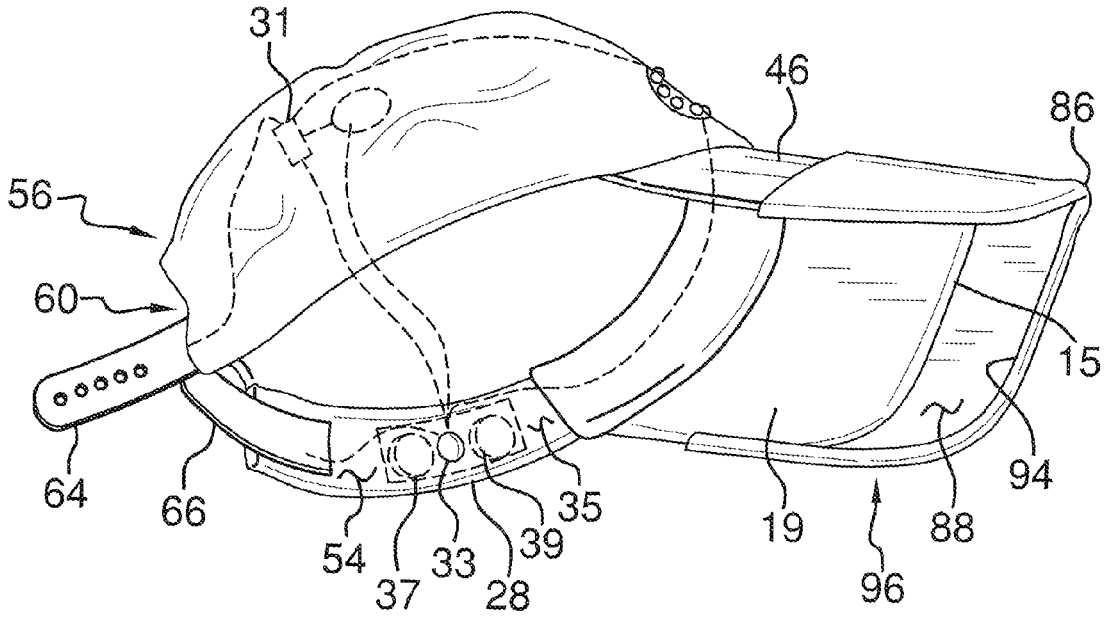
FIG. 6 is a bottom view of an embodiment of the disclosure.
Figure 7:
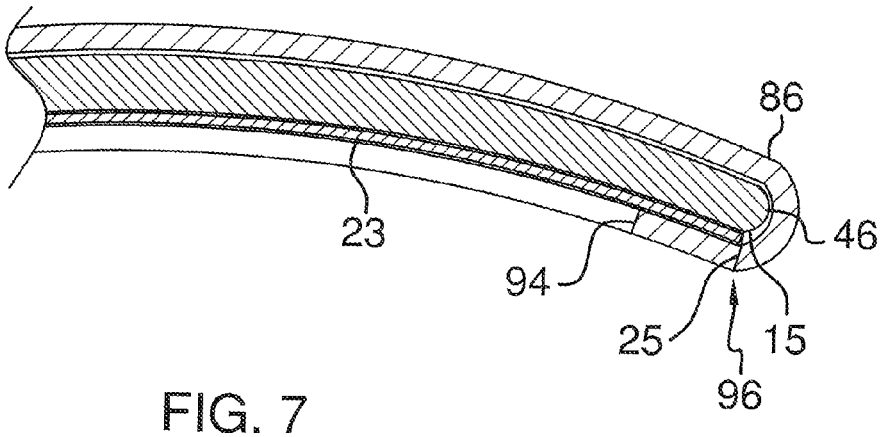
FIG. 7 is a cross sectional view taken along line 7-7 of FIG. 3 of an embodiment of the disclosure.
Figure 8:
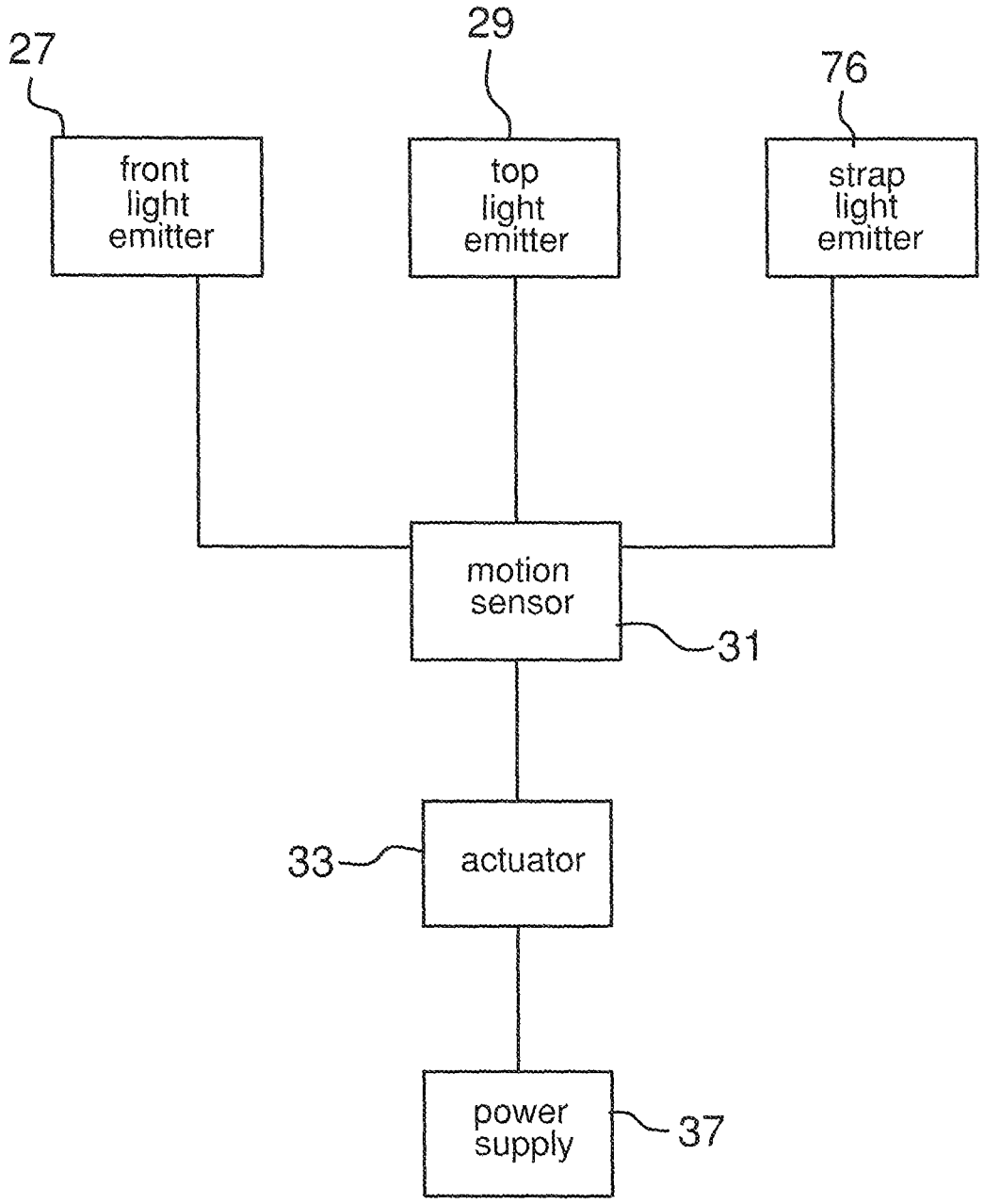
FIG. 8 is a schematic view of an embodiment of the disclosure.

With reference now to the drawings, and in particular to FIGS. 1 through 8 thereof, a new illuminated head-gear device embodying the principles and concepts of an embodiment of the disclosure and generally designated by the reference numeral 10 will be described.

As best illustrated in FIGS. 1 through 8, the illuminated head-gear assembly 10 generally comprises a cap 12 to be worn on a user's head 14. A plurality of air apertures 16 extends through a top 18 of the cap 12 so air may escape from between the user's head 14 and the cap 12. The cap 12 may be comprised of a deformable material. Additionally, the cap 12 may resemble a baseball cap 20 of any conventional design.

A plurality of first fasteners 22 is coupled to an inside surface 24 of a front 26 of the cap 12 proximate a bottom edge 28 of the cap 12. The plurality of first fasteners 22 is evenly distributed between a first lateral side 30 and a second lateral side 32 of the cap 12. A retainer 34 is removably coupled to the inside surface 24 of the front 26 of the cap 12. The retainer 34 may have a length between 17 cm and 23 cm. A plurality of second fasteners 36 is coupled to a front 38 of the retainer 34 so the plurality of second fasteners 36 is evenly distributed between a first end 40 and a second end 42 of the retainer 34. The first 22 and second 36 fasteners are complementary so the retainer 34 is removably coupled to the inside surface 24 of the front 26 of the cap 12 such that a free portion 44 of the retainer 34 extends forwardly from the front 26 of the cap 12. The first 22 and second 36 fasteners may comprise hook and loop fasteners of any conventional design.

A brim 46 is positionable on the retainer 34 so a rear 48 of the brim 46 insertably receives the free portion 44 of the retainer 34. The rear 48 of the brim 46 is curvilinear with the front 26 of the cap 12 so the rear 48 of the brim 46 abuts an entire width of the front 26 of the cap 12. The brim 46 extends forwardly from the front 26 of the cap 12 so the brim 46 may shade the user's face 50. Additionally, the brim 46 may have a length. between 12 cm and 18 cm and a width between 17 cm and 23 cm.

A third fastener 52 is coupled to an inside surface 54 of a rear 56 of the cap 12 proximate the bottom edge 28 of the cap 12. The third fastener 52 is one of a pair of third fasteners 52 each positioned proximate an associated one of opposite sides 58 of an opening 60 in the rear 56 of the cap 12. The third fastener 52 may comprise a hook and loop fastener.

A strap 62 is removably coupled to the cap 12 so the strap 62 adjusts a size of the cap 12. The strap 62 may have a length between 5 cm and 8 cm. The strap 62 is one of a pair of straps 62 each being positionable proximate an associated one of the opposites sides 58 of the opening 60 in the rear 56 of the cap 12. A first one 64 and a second one 66 of the straps 62 each extends laterally across the opening 60 in the rear 56 of the cap 12 when the first 64 and second 66 straps are coupled to the cap 12. The first 64 and second 66 straps may come in a plurality of selectable colors to alter the appearance of the cap 12, A fourth fastener 68 is coupled to a coupling end 70 of the strap 62. The fourth fastener 68 is one of a pair of the fourth fasteners 68 each coupled to an associated one of the first. 64 and second 66 straps. The fourth fastener 68 may comprise a hook and loop fastener. The third 52 and fourth 68 fasteners are complementary so the pair of straps 62 is removably coupled to the inside surface 54 of the rear 56 of the cap 12.

A pair of first contacts 72 is coupled to the coupling end 70 of the strap 62. The pair of first contacts 72 is one of a pair of sets of first contacts 72 that are each coupled to an associated one of the first 64 and second 66 straps. A plurality of strap light emitters 76 is coupled to the first strap 64 such that the plurality of strap light emitters 76 is evenly distributed between the coupling end 70 and a free end 78 of the first strap 64. Additionally, the plurality of strap light emitters 76 may comprise an LED of any conventional design capable of emitting a plurality of colors of light.

The plurality of strap light emitters 76 is electrically coupled to a first set 78 of the pair of first contacts 72. A plurality of strap apertures 80 extends through a front 82 and a back 84 of the second strap 66. Each of the plurality of strap apertures 80 may insertably receive an associated one of the plurality of strap light emitters 76 to removably couple to first strap 64 to the second strap 66. Further, the plurality of strap apertures 80 may insertably receive a selected number of the plurality of strap light emitters 76 to adjust the cap 12 between a minimum and a maximum size.

A first sleeve 86 is positionable on the brim 46 so a bottom surface 88 of the first sleeve 86 coextensively abuts a top surface 90 of the brim 46. A rear edge 92 of the first sleeve 86 is curvilinear with the rear 48 of the brim 46 so the first sleeve 86 may completely cover the top surface 90 of the brim 46. The first sleeve 86 may come in a plurality of colors so first sleeve 86 may alter the appearance of the brim 46. An outside edge 94 of the first sleeve 86 is bent downwardly in a C-shape to define a coupling portion 96 of the first sleeve 86. The coupling portion 96 of the first sleeve 86 extends around a first lateral side 98, a front side 11, and a second lateral side 13 of the first sleeve 86. Additionally, the coupling portion 96 of the first sleeve 86 engages an outside edge 15 of the brim 46 so the first sleeve 86 is retained on the brim 46.

A second sleeve 17 is positionable on a bottom 19 of the brim 46. A rear edge 21 of the second sleeve 17 is curvilinear with the rear 48 of the brim 46 so the second sleeve 17 may completely cover the bottom 19 of the brim 46. The second sleeve 17 may come in a plurality of colors to alter the appearance of the brim 46. A support 23 is positionable on the bottom 19 of the brim 46 after the first sleeve 86 and the second sleeve 17 is positioned on the brim 46. The coupling portion 96 of the first sleeve 86 engages an outside edge 25 of the support 23 so the support 23 is retained on the bottom 19 of the brim 46. The support 23 retains with the second sleeve 17 on the bottom 19 of the brim 46 to prevent the second sleeve 17 from hanging downwardly from the brim 46.

A front light emitter 27 is coupled to and centrally positioned on the front 26 of the cap 12 so the front light emitter 27 emits light. The front light emitter 27 may comprise an LED of any conventional design capable of emitting a plurality of colors of light. The front light emitter 27 may comprise a plurality of front light emitters 27 arranged in a circular pattern. A top light emitter 29 is removably coupled to and centrally positioned on the top 18 of the cap 12 so the top light emitter 29 emits light. The top light emitter 29 may comprise an LED of any conventional design capable of emitting a plurality of colors of light.

A motion sensor 31 is coupled to the top 18 of the cap 12 and the motion sensor 31 is electrically coupled to the front light emitter 27, the top light emitter 29 and the plurality of strap light emitters 76. The motion sensor 31 detects when the cap 12 is in motion so the motion detector 31 may selectively actuate the front 27, top 29, and plurality of strap light emitters 76. The motion sensor 31 de-actuates the front 27, top 29 and plurality of strap light emitters 76 if the motion sensor 31 ceases to detect motion.

An actuator 33 is coupled to an inside surface 35 of the first lateral side 30 of the cap 12 proximate the bottom edge 28 of the cap 12 and the actuator 33 is actuated by the user 49. The actuator 33 is electrically coupled to the motion sensor 31 so the actuator 33 may selectively actuate and de-actuate the motion sensor 31. A power supply 37 is coupled to the inside surface 35 of the first lateral side 30 of the cap 12 proximate the bottom edge 28 of the cap 12. The power supply 37 is electrically coupled to the actuator 33 and the power supply 37 may comprise at least one battery 39. The power supply 37 may have an operational voltage between 3 volts DC and 6 volts DC A pair of second contacts 41 is coupled to the inside surface 54 of the rear 56 of the cap 12. The pair of second contacts 41 is electrically coupled to the motion sensor 31. Additionally, the pair of second contacts 41 is one of a pair of sets of the pairs of second contacts 41. Each of a first 43 and a second 45 set of the pair of second contacts 41 is positioned proximate an associated one of the opposite sides 58 of the opening 60 in the rear 56 of the cap 12. Further, each of the first 43 and second 45 sets of the pair of second contacts 41 is selectively electrically coupled to an associated one of the first set 78 and a second set 47 of the pair of first contacts 72 when an associated one of the first 64 and the second 66 straps is removably coupled to the cap 12.

In use, the user 49 selects a color of the first 86 and second 17 sleeves to position on the brim 46. The first sleeve 86 may be used with or without the second sleeve 17 and the support 23. Additionally, the user 49 selects a color of the first 64 and second 66 straps to be coupled to the rear 56 of the cap 12. The cap 12 may be worn with or without the top light emitter 29. Alternatively, the first sleeve 86 may be positioned on a brim 46 that is permanently affixed to the cap 12 to alter the appearance of the brim 46 that is permanently affixed to the cap 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An illuminated head-gear assembly for receiving removable accoutrements, said assembly comprising:

a cap configured to be worn on a user's head;

a retainer removably coupled to said cap;

a brim removably coupled to said retainer wherein said brim is configured to shade the user's face;

a strap removably coupled to said cap wherein said strap adjusts a size of said cap;

a first sleeve positionable on said brim wherein said first sleeve alters an appearance of said brim;

a front light emitter coupled to said cap wherein said front light emitter emits light;

a top light emitter coupled to said cap wherein said top light emitter emits light;

a motion sensor coupled to said cap, said motion sensor being operationally coupled to said front and top light emitters wherein said motion sensor selectively actuates said front and top light emitters;

an actuator coupled to said cap, said actuator being operationally coupled to said motion sensor wherein said actuator actuates said motion sensor;

a pair of second contacts coupled to an inside surface of a rear of said cap;

said pair of second contacts being electrically coupled to said motion sensor;

said pair of second contacts being one of a pair of sets of said pairs of second contacts;

each of a first and a second set of said pair of second contacts being positioned proximate an associated one of opposite sides of an opening in said rear of said cap; and each of said first and second sets of said pair of second contacts being selectively electrically coupled to a pair of first contacts when an associated one of a first and a second strap is removably coupled to said cap.

2. The assembly according to claim 1, further comprising:

a plurality of first fasteners coupled to an inside surface of a front of said cap proximate a bottom edge of said cap wherein said plurality of first fasteners is evenly distributed between a first lateral side and a second lateral side of said cap;

a plurality of second fasteners coupled to a front of said retainer wherein said plurality of second fasteners is evenly distributed between a first end and a second end of said retainer; and said first and second fasteners being complementary wherein said retainer is removably coupled to said inside surface of said front of said cap such that a free portion of said retainer extends forwardly from said front of said cap.

3. The assembly according to claim 1, further comprising:

a third fastener coupled to an inside surface of a rear of said cap proximate a bottom edge of said cap;

a fourth fastener coupled to a coupling end of said strap;

the pair of first contacts coupled to said coupling end of said strap; and said third and fourth fasteners being complementary wherein said strap is removably coupled to said inside surface of said rear of said cap.

4. The assembly according to claim 3, further comprising:

said third fastener being one of a pair of third fasteners each positioned proximate an associated one of opposite sides of an opening in said rear of said cap; and said strap being one of a pair of said straps each being positionable proximate an associated one of opposites side of said opening in said rear of said cap such that a first one and a second one of said straps each extends laterally across said opening in said rear of said cap.

5. The assembly according to claim 1, further comprising:

said first sleeve being positionable on said brim wherein a bottom surface of said first sleeve coextensively abuts a top surface of said brim;

an outside edge of said first sleeve being bent downwardly in a C-shape to define a coupling portion of said first sleeve extending around a first lateral side, a front side, and a second lateral side of said first sleeve; and said coupling portion of said first sleeve engaging an outside edge of said brim wherein said first sleeve is retained on said brim.

6. The assembly according to claim 1, further comprising a second sleeve being positionable on a bottom of said brim.

7. The assembly according to claim 6, further comprising a support being positionable on a bottom of said brim after said first sleeve and said second sleeve is positioned on said brim wherein a coupling portion of said first sleeve engages an outside edge of said support wherein said support is retained on said bottom of said brim wherein said support retains said second sleeve on said bottom of said brim.

8. The assembly according to claim 1, further comprising:

said front light emitter being coupled to and centrally positioned on a front of said cap; and said top light emitter being removably coupled to and centrally positioned on a top of said cap.

9. The assembly according to claim 1, further comprising:

said motion sensor being coupled to a top of said cap;

said motion sensor being electrically coupled to said front light emitter, said top light emitter and a plurality of a strap light emitters;

said motion sensor detecting motion wherein said motion detector selectively actuates said front, top and said plurality of said strap light emitters.

10. The assembly according to claim 1, further comprising:

said actuator being coupled to an inside surface of a first lateral side of said cap proximate a bottom edge of said cap; and said actuator being electrically coupled to said motion sensor wherein said actuator selectively actuates said motion sensor.

11. The assembly according to claim 1, further comprising:

a power supply coupled to an inside surface of a first lateral side of said cap proximate a bottom edge of said cap;

said power supply being electrically coupled to said actuator; and said power supply comprising at least one battery.

12. An illuminated head-gear assembly for receiving removable accoutrements, said assembly comprising:

a cap configured to be worn on a user's head;

a retainer removably coupled to said cap;

a brim removably coupled to said retainer wherein said brim is configured to shade the user's face;

a strap removably coupled to said cap wherein said strap adjusts a size of said cap;

a first sleeve positionable on said brim wherein said first sleeve alters an appearance of said brim;

a front light emitter coupled to said cap wherein said front light emitter emits light;

a top light emitter coupled to said cap wherein said top light emitter emits light;

a motion sensor coupled to said cap, said motion sensor being operationally coupled to said front and top light emitters wherein said motion sensor selectively actuates said front and top light emitters; and an actuator coupled to said cap, said actuator being operationally coupled to said motion sensor wherein said actuator actuates said motion sensor;

a third fastener coupled to an inside surface of a rear of said cap proximate a bottom edge of said cap;

a fourth fastener coupled to a coupling end of said strap;

a pair of first contacts coupled to said coupling end of said strap;

said third and fourth fasteners being complementary wherein said strap is removably coupled to said inside surface of said rear of said cap, said third fastener being one of a pair of third fasteners each positioned proximate an associated one of opposite sides of an opening in said rear of said cap;

said strap being one of a pair of said straps each being positionable proximate an associated one of opposites side of said opening in said rear of said cap such that a first one and a second one of said straps each extends laterally across said opening in said rear of said cap;

a plurality of strap light emitters coupled to said first strap such that said plurality of strap light emitters are evenly distributed between said coupling end and a free end of said first strap wherein said plurality of strap light emitters emits light;

said plurality of strap light emitters being electrically coupled to said pair of first contacts; and a plurality of strap apertures extending through a front and a back of said second strap wherein said each of said plurality of strap apertures insertably receives an associated one of said strap light emitters wherein said first strap is removably coupled to said second strap.

13. An illuminated head-gear assembly for receiving removable accoutrements, said assembly comprising:

a cap configured to be worn on a user's head;

a plurality of first fasteners coupled to an inside surface of a front of said cap proximate a bottom edge of said cap wherein said plurality of first fasteners are evenly distributed between a first lateral side and a second lateral side of said cap;

a retainer removably coupled to an inside surface of said cap;

a plurality of second fasteners coupled to a front of said retainer wherein said plurality of second fasteners are evenly distributed between a first end and a second end of said retainer, said first and second fasteners being complementary wherein said retainer is removably coupled to said inside surface of said front of said cap such that a free portion of said retainer extends forwardly from said front of said cap;

a brim removably coupled to said retainer wherein said brim is configured to shade the user's face;

a third fastener coupled to an inside surface of a rear of said cap proximate said bottom edge of said cap, said third fastener being one of a pair of third fasteners each positioned proximate an associated one of opposite sides of an opening in said rear of said cap;

a strap removably coupled to said cap wherein said strap adjusts a size of said cap, said strap being one of a pair of said straps each being positionable proximate an associated one of opposites side of said opening in said rear of said cap such that a first one and a second one of said straps each extends laterally across said opening in said rear of said cap;

a fourth fastener coupled to a coupling end of said strap, said fourth fastener being one of a pair of said fourth fasteners each coupled to an associated one of said first and second straps, said third and fourth fasteners being complementary wherein said pair of said straps is removably coupled to said inside surface of said rear of said cap;

a pair of first contacts coupled to said coupling end of said strap, said pair of first contacts being one of a pair of sets of first contacts each being coupled to an associated one of said first and second straps;

a plurality of strap light emitters coupled to said first strap such that said plurality of strap light emitters are evenly distributed between said coupling end and a free end of said first strap wherein said plurality of strap light emitters emits light, said plurality of strap light emitters being electrically coupled to a first set of said pair of first contacts;

a plurality of strap apertures extending through a front and a back of said second strap wherein said each of said plurality of strap apertures insertably receives an associated one of said strap light emitters wherein said first strap is removably coupled to said second strap;

a first sleeve being positionable on said brim wherein a bottom surface of said first sleeve coextensively abuts a top surface of said brim wherein said first sleeve alters an appearance of said brim, an outside edge of said first sleeve being bent downwardly in a C-shape to define a coupling portion of said first sleeve extending around a first lateral side, a front side, and a second lateral side of said first sleeve, said coupling portion of said first sleeve engaging an outside edge of said brim wherein said first sleeve is retained on said brim;

a second sleeve being positionable on a bottom of said brim wherein said second sleeve alters an appearance of said brim;

a support being positionable on said bottom of said brim after said first sleeve and said second sleeve is positioned on said brim wherein said coupling portion of said first sleeve engages an outside edge of said support wherein said support is retained on said bottom of said brim wherein said support retains said second sleeve on said bottom of said brim;

a front light emitter coupled to and centrally positioned on said front of said cap wherein said front light emitter emits light;

a top light emitter removably coupled to and centrally positioned on a top of said cap wherein said top light emitter emits light;

a motion sensor coupled to said top of said cap, said motion sensor being electrically coupled to said front light emitter, said top light emitter and said plurality of said strap light emitters, said motion sensor detecting motion wherein said motion detector selectively actuates said front light emitter, said top light emitter and said plurality of said strap light emitters;

an actuator coupled to an inside surface of said first lateral side of said cap proximate said bottom edge of said cap, said actuator being electrically coupled to said motion sensor wherein said actuator selectively actuates said motion sensor;

a power supply coupled to said inside surface of said first lateral side of said cap proximate said bottom edge of said cap, said power supply being electrically coupled to said actuator, said power supply comprising at least one battery; and a pair of second contacts coupled to said inside surface of said rear of said cap, said pair of second contacts being electrically coupled to said motion sensor, said pair of second contacts being one of a pair of sets of said pairs of second contacts, each of a first and a second set of said pair of second contacts being positioned proximate an associated one of opposite sides of said opening in said rear of said cap, each of said first and second sets of said pair of second contacts being selectively electrically coupled to said pair of first contacts when an associated one of said first and said second straps is removably coupled to said cap.

* * * * *